United States Patent [19]

Bingham

[11] Patent Number: 4,533,592

[45] Date of Patent: Aug. 6, 1985

[54] THERMALLY STABLE FLAME RETARDANT REFLECTIVE AND RETROREFLECTIVE TRIM

[75] Inventor: Wallace K. Bingham, North St. Paul, Minn.

[73] Assignee: Minnesota Mining and Manufacturing Company, Saint Paul, Minn.

[21] Appl. No.: 636,981

[22] Filed: Aug. 2, 1984

[51] Int. Cl.[3] ..... G09F 13/16

[52] U.S. Cl. ..... 428/213; 428/219; 428/241; 428/248; 428/251; 428/252; 428/325; 428/913; 428/921

[58] Field of Search ..... 428/213, 219, 241, 248, 428/251, 252, 325, 913, 921

[56] References Cited

U.S. PATENT DOCUMENTS

| | | | |
|---|---|---|---|
| 3,172,942 | 3/1965 | Berg | 88/82 |
| 3,549,307 | 12/1970 | Hirsch | 8/115 |
| 3,607,798 | 9/1971 | Hirsch | 260/2.5 |
| 3,684,348 | 8/1972 | Rowland | 350/103 |
| 3,700,305 | 10/1972 | Bingham | 350/105 |
| 3,758,192 | 9/1973 | Bingham | 350/105 |
| 3,992,080 | 11/1976 | Rowland | 350/103 |
| 4,047,965 | 9/1977 | Karst et al. | 106/65 |

OTHER PUBLICATIONS

Reeves, W. A. "Fire-Resistant Apparel Fabrics", *CRC Critical Reviews in Environmental Control*, pp. 91-100 (Dec. 1977).

Drake, G. L. "Fire Retardance: Its Status Today", *American Dyestuff Reporter*, May, 1971, pp. 43-47.

*Primary Examiner*—Marion E. McCamish

*Attorney, Agent, or Firm*—D. M. Sell; J. A. Smith; D. B. Little

[57] ABSTRACT

A new trim material is disclosed comprising a fire resistant fabric having a weight of at least about 85 g/m$^2$ and characterized by:

(A) A fluorescent coating;

(B) a flexible, drapable, stretchable, retroreflective sheeting covering a portion of the fluorescent coating of part (A);

(C) the combined thickness of the fluorescent coating and any flammable part of the retroreflective sheeting being about 5 to 60% of the thickness of the fire resistant fabric.

This trim material is useful for such articles such as firemen's coats in that it meets most of the same requirements for flame retardance as are applied to the outer shell material itself. Specifically, it retains its reflectivity in a laboratory oven test at 260° C. for five minutes and retains the color of the fluorescent portion at 204° C. in a laboratory oven for five minutes. The fabric properties of strength, fire retardancy, and resistance to heat are preserved in the composite trim material.

7 Claims, 2 Drawing Figures

THERMALLY STABLE FLAME RETARDANT REFLECTIVE AND RETROREFLECTIVE TRIM

TECHNICAL FIELD

This invention relates to retroreflective sheeting such as fabric adapted for use on rain coats, jackets and other garments.

BACKGROUND

The requirements for fabric for firemen's coats and other protective clothing and devices are not only stringent but have never been completely met by commercially available trim products to date. The National Fire Protection Association (NFPA) Standard on Protective Clothing for Structural Fire Fighting specifies that: (1) the outer shell material of protective clothing for fire fighting shall not char, separate, or melt when placed in a forced air laboratory oven at a temperature of 500° F. (260° C.) for a period of five minutes; (2) firemen's coats shall be trimmed with at least 325 square inches (0.21 $m^2$) of retroreflective fluorescent tape in a configuration which includes at least tape around each sleeve and a band around the bottom of the coat near the hem; and (3) the use of fluorescent retroreflective trim material is an important safety feature for fire fighter's outer wear, important characteristics of such trim being shrinkage with temperature, the temperature at which the material will char or melt and drip, and the effects of temperature exposure in a forced air oven.

A commonly used trim for firemen's coats comprises a plastic sheet material having cube corner optical elements for retroreflectivity which sheet material is bonded to a fabric scrim in such a way as to provide rectangular cells which provide the air interface at the tetrahedra of the cube corners needed for reflectivity. Although this type of trim is glossy, retroreflective and easily cleaned, it suffers significant (80%) loss of reflectivity at 300° F. (149° C.), 100% reflectivity loss at 350° F. (177° C.) and is virtually destroyed at 450° to 500° F. (232°–260° C.).

The use of retroreflective markings on various articles of clothing is well known in the art, see U.S. Pat. Nos. 2,567,233 and 3,172,942. The retroreflective sheet material of U.S. Pat. No. 2,567,233 provides a flexible weather resistant sheet comprising a light-reflective binder coating in which is partially embedded a firmly but resiliently bonded surface layer of small, transparent, convex lens elements such as glass beads or microspheres, preferably having a refractive index of about 1.7 to 1.9 and a diameter of less than about 10 mils (250 micrometers). Bead diameter is typically about 40 to 150 micrometers. The binder is typically a rubbery polymer such as butadiene-acrylonitrile copolymer containing a reflective pigment such as aluminum flakes as well as resin and a plasticizer. Such retroreflective sheeting may be provided with a heat activated or solvent activated adhesive on the side opposite the glass beads and thereby be bonded to garments or fabric.

Retroreflective sheeting may have a reflective (e.g. aluminum) coating placed on the backs of or behind the glass beads, rather than being provided by loading the binder layer with aluminum flakes or particles. The manufacture of retroreflective sheeting products is described in U.S. Pat. No. 2,567,233 at columns 3–5 and U.S. Pat. No. 3,172,942 at columns 4–7.

Alternatively, the reflective means may comprise a series of transparent dielectrics (i.e. a dielectric reflector), each having a thickness which is an odd numbered multiple of about one-fourth of the wavelength of light in the wavelength range of about 3,800 to 10,000 angstroms, as described in U.S. Pat. No. 3,700,305. The refractive index of each transparent dielectric layer must be at least 0.1 (preferably at least 0.3) higher or lower than that of the adjacent layers.

There are several other varieties of retroreflective sheeting besides the exposed lens variety (i.e. glass beads exposed to air) described above: enclosed lens sheeting having a transparent layer covering the outer surface of the glass beads; encapsulated lens sheeting having a transparent polymeric layer over the front of the glass microspheres and bonded in such a way as to result in air cells infront of the microspheres; and cube corner reflective sheeting which uses tetrahedra or other prismatic corner shapes as the lens elements instead of glass microspheres.

For purposes of this discussion, the lens elements may mean either cube corner reflectors or glass or glass-like beads or microspheres. Also, the term retroreflective sheeting as used herein may mean any of the above-described types of sheeting.

The patents referred to above dealing with retroreflective sheeting do not propose its use in fire fighter's garments and they are not designed to pass the rigid tests previously mentioned. Indeed, most would burn, char, melt or drip upon exposure to fire or in an oven at 260° C. for ten minutes.

It is the object of this invention to produce a trim which is useful for fire fighters' garments which is: flame retardant, resistant to melting, charring or dimensional change in a 500° F. (260° C.) air circulating oven for five minutes, highly retroreflective, fluorescent and resistant to dirt and soot accumulation and/or easily cleaned.

DISCLOSURE OF THE INVENTION

A product meeting all of the above objects has now been made and may be described as a material suitable for incorporation into fabrics which will be exposed to high temperatures which material comprises a fire resistant fabric having a weight of at least 2.5 ounces/yard$^2$ (85 g/$m^2$) and characterized by:

(A) a fluorescent coating on the fabric;

(B) a flexible, drapable, stretchable retroreflective sheeting covering a portion of the material and comprising a layer of transparent lens elements in optical connection with a reflecting means;

(C) the combined thicknesses of the fluorescent coating and any flammable part of the retroreflective sheeting being about 5 to 60 percent of the thickness of the fire resistant fabric.

The term thickness as applied to the fluorescent coating and any flammable part of the retroreflective sheeting means the thickness which they add over the thickness of the fire resistant fabric. Thus, the combined thickness in part (C) does not include, for example, any part of an adhesive on the back of a retroreflective sheeting which is actually within the interstices of the fire resistant fabric, nor any glass bead lens elements which are not flammable. This thickness also refers to dry thickness of the finished trim, not wet or in-process thickness.

For purposes of this description, the term fire resistant fabric means a fabric characterized by the following properties:

(A) will not char or melt when held in a forced air oven at 260° C. for 5 minutes;

(B) char length less than 4.0 in (10.2 cm) as measured by U.S. Federal Test Method Standard 191, Textile Test Methods, Method 5903;

(C) all the above being applicable after 5 cycles of laundering and drying in accordance with American Association of Textile Chemists and Colorists (AATCC) Method 96-Test-V-E.

The fluorescent coating, which is usually bright yellow or red, is provided to achieve high day time visibility and also to provide a smooth or gloss surface for ease of cleaning and aesthetic appeal. It should have at least 75 percent, reflectivity in its dominant wavelength to help provide contrast in daylight.

The retroreflective sheeting is usually bonded to the fluorescent coating in a pattern such as a single center stripe, two narrow side stripes, or a single wide stripe down one side. It is generally desired to leave at least 50% of the surface of the trim material as a gloss, fluorescent exposed color coat for contrast and daytime visibility.

The trim material of this invention may be attached to garments by sewing.

One of the surprising aspects of this product is the fact that thermoplastic materials have been used as both the fluorescent color coat and the retroreflective sheeting component; yet, when exposed to high heat, these materials do not melt and drip as they would ordinarily (causing a hazard to the wearer of a safety garment). Instead, they seem to take on the thermal resistance characteristics of the fabric, retaining color and retroreflective characteristics very well at elevated temperatures. The glass bead/aluminum layer of certain exposed lens retroreflective sheeting used to develop this invention continued to reflect up to the point of fabric disintegration (600°-700° F., 316°-371° C.).

DETAILED DESCRIPTION

Figure 1:
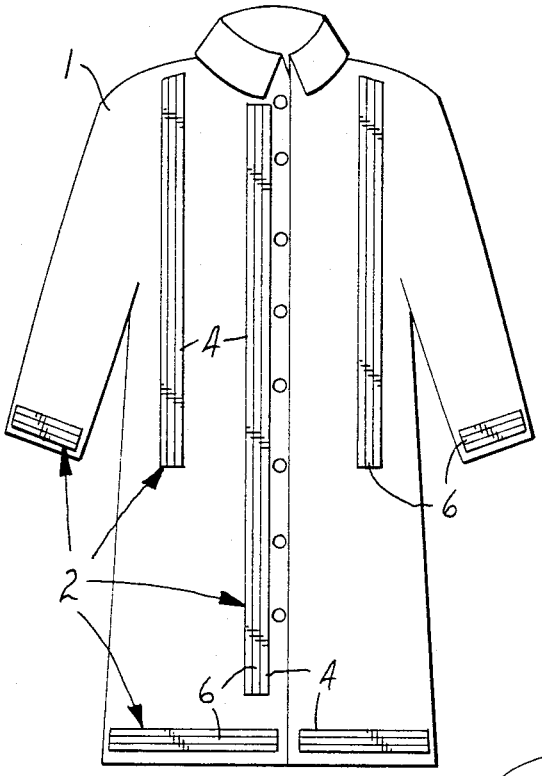
FIG. 1 is a front view and FIG. 2 is a back view of a firemen's coat 1 showing the inventive trim material 2 in an exemplary pattern. The fluorescent coating is designated number 4 and the retroreflective sheeting designated number 6.

The fire resistant fabric contributes greatly to the thermal stability and fire retardance of the final product and can be a woven fabric of fire retardant treated 100% cotton, aramid yarns (e.g. Nomex nylon), modacrylic fibers, glass fiber, ceramic fibers (such as disclosed in U.S. Pat. Nos. 3,709,706; 3,795,524; or 4,047,965), or blends of the foregoing.

Fire retardant cotton for use in this invention may be cotton duck, twill or jeans fabric of about 5 to 100 mils (0.1-2.5 mm) in thickness which has been treated by the conventional pad/dry/cure technique with an effective fire retardant. There are many known fire retardants for cotton, one example being tetrakis (hydroxy-methyl) phosphonium chloride (Thpc). Formulations comprising Thpc, trimethylolmelamine and urea in various ratios (e.g. 2:4:1 mole ratio Thpc: urea:trimethyloylmelamine) have been employed. The principle of such fire retardants is to form insoluble polymers in cotton concurrently with some reaction with the cotton fiber itself to lend durability to the fire retardant. In the process of making fire retardant fabrics, the untreated fabric is padded with a solution containing the Thpc and other reagents, dried, cured, washed, softened and then dried again. One known process for imparting flame resistance to cotton is the Roxel process (Roxel being a trademark of Hooker Chemical Corporation). It is also known to cure fire retardant fabrics by the ammonia cure process in which dried, impregnated fabric is exposed to ammonia vapor and/or ammonium hydroxide solution.

There are many varieties of Thpc type fire retardants for cotton such as Thpc-urea-$Na_2HPO_4$, and Thpc-trimethylolmelamine-urea with antimony oxide added. Further information on fire resistant fabrics may be found on Reeves, W. A., "Fire-Resistant Apparel Fabrics", *CRC Critical Reviews in Environmental Control*, pp. 91-100 (December, 1977) and in U.S. Pat. Nos. 3,549,307 and 3,607,798.

Several procedures have been used to apply the fluorescent coating, one of which is direct knife coating of a vinyl organosol or plastisol onto a fabric substrate with subsequent fusing or curing. A second procedure is to knife coat a fluorescent pigmented high molecular weight thermoplastic polyurethane solution onto a high gloss release paper. This coating is backed with a white pigmented thermoplastic polyurethane resin containing flame retardant components. An adhesive layer is then solution cast onto the white pigmented thermoplastic polyurethane resin coating. This paper-carried color coat combination is hot laminated to a fire retardant fabric, and the paper is subsequently removed to expose the fluorescent color. A Nomex aramid duck fabric was used as the base fabric for this urethane color coat in the work leading to this invention, the fabric being 7½ ounces per square yard (254 grams per square meter).

The retroreflective sheeting is most preferably of very high brightness in order to minimize the proportion of the fluorescent coating which must be covered to provide sufficient night time visibility from the retroreflective sheeting. This brightness is about 400 candle power or higher and is achieved with certain exposed lens beaded constructions and cube corner (prismatic lens) systems.

U.S. Pat. No. 3,684,348 describes cube corner retroreflective sheeting comprising basically a plastic body portion having substantially smooth surfaces on opposite sides and a multiplicity of minute cube corner formations projecting from one of the smooth sides, each cube corner formation having three faces and a base adjacent the body portion. The body portion and the cube corner formations are separately formed from essentially transparent synthetic resins and are bonded together to form a composite structure. To provide optimum reflectivity, the composite material has a reflective coating deposited on the cube corner formations. Resins preferably employed for the body portion include: polyvinyl halides, polyethylene terephthalate, polyvinylidene chloride, polycarbonates, polysulfones and cellulose ester polymers. The resins preferably employed for the cube corner formations comprise: acrylic acid ester resins, acrylic modified vinyl chloride resins, vinyl chloride/vinyl acetate copolymers, ethylenically unsaturated nitrile resins, monovinylidene aromatic hydrocarbon resins, olefin resins, cellulose ester resins, polysulfone resins polyphenylene oxide resins and polycarbonates. Further information on cube corner retroreflective sheeting may be found in U.S. Pat. No. 3,992,080.

A type of exposed lens retroreflective sheeting was utilized in reducing this invention to practice. It comprised essentially four layers: an outer layer of closest cubic packed glass beads of about 45 to 65 micrometers in diameter; an aluminum coating about 700 angstroms thick over the beads; a binding resin coating of about 0.025 mm in thickness which bound the glass bead-/aluminum layer together; and a fourth layer of thermoplastic adhesive of roughly 0.038 mm thick on the back of the binder coat. The chemical nature of the binding layer was a mixture of acrylonitrile butadiene elastomer, phenol formaldahyde one step thermosetting resin and dioctylphthalate plasticizer. The adhesive was entirely high molecular weight thermoplastic polyurethane made from an aromatic diisocyanate and a polyester.

Other suitable adhesives for adhering the retroreflective sheeting to the coated fabric are:

(a) solution grade vinyl adhesive (such as VAGH, VMCH or vYHH from Union Carbide Corp. or polyvinyl acetate/polyvinyl chloride copolymers);
(b) the vinyl adhesives of (a) above in combination with a plasticizer (such as dioctylphthalate, dibutylphthalate and t-cresylphosphate) to achieve flexibility and elasticity;
(c) thermoplastic polyester and polyether urethane elastomers (such as Estane polyurethane resin from B. F. Goodrich Chemical Co.);
(d) films of linear, saturated polyester resins, such as Yitel PE55Y5 from Goodyear Tire & Rubber Co.;
(e) combinations of (a) or (b) with (c) above; or
(f) thermoplastic polyamide resin adhesives.

Another type of retroreflective sheeting useful in this invention is the enclosed lens type which has a transparent spacing layer between the microsphere lens elements and the reflecting means to place the reflecting means at the approximate focal point of light rays passing through each lens element.

The invention will be further clarified by the following examples which are intended to be purely exemplary.

Example I

The following two solutions were prepared for the fluorescent coating:

| | | % by Weight |
|---|---|---|
| | Solution A | |
| 1. | Methyl ethyl ketone | 21.33 |
| 2. | Cyclohexanone | 8.0 |
| 3. | Toluene | 22.0 |
| 4. | Methyl isobutyl ketone | 16.67 |
| 5. | High molecular weight polyurethane resin made from an aromatic diisocyanate and a polyester (Estane 5703 from B. F. Goodrich Chemical Co.) | 12.0 |
| 6. | A copolymer of 86:13 weight ratio vinyl chloride-vinyl acetate resin with 1% interpolymerized maleic acid (VMCH resin from Union Carbide Corp.) | 3.33 |
| 7. | A finely divided organic resin in which is molecularly dissolved a yellow fluorescent dye (Saturn yellow GT-17 pigment from DAY-GLO Color Corp.) | 16.67 |
| | Solution B | |
| 1. | Methyl ethyl ketone | 25.66 |
| 2. | Cyclohexanone | 7.20 |
| 3. | Toluene | 18.70 |
| 4. | Dioctyl phthalate | 14.60 |
| 5. | Vinyl resin stabilizer comprising a derivative of mixed calcium and zinc salts of p-tert-butyl benzoic acid | 1.00 |
| 6. | Highly crystalline high molecular weight polyurethane resin made from an aromatic diisocyanate and a polyester (Estane 4713) of B. F. Goodrich Chemical Company) | 3.09 |
| 7. | Rutile titanium dioxide | 7.93 |
| 8. | A copolymer of 86:14 weight ratio vinyl chloride:vinyl acetate resin (VYHH resin from Union Carbide Corp.) | 21.82 |

A fluorescent coating was prepared by knife coating a layer of solution A (0.2 mm. wet thickness) onto a polyethylene coated kraft paper carrier and oven drying the coated paper for twenty minutes at 72° C. A layer of solution B was knife coated (0.25 mm wet thickness) over the dried coating of solution A, and this second coating was dried in an oven for five minutes at 65° C. and for 12 minutes at 93° C.

A quantity of bleached cotton jeans fabric was obtained, weighing 161.2 grams per square meter, having a thread count of 96×64. It had been treated with a flame retardant by the known ammonia cure process. The fluorescent coating was laminated to this fabric by passing the fabric and the fluorescent coating through the nip formed by a roll covered with silicone rubber which was in contact with a steel roll heated to 375° F., the force between the two rolls being 40 psi. After this lamination step, the paper liner was removed from the fluorescent coating to expose the glossy fluorescent finish.

Figure 2:
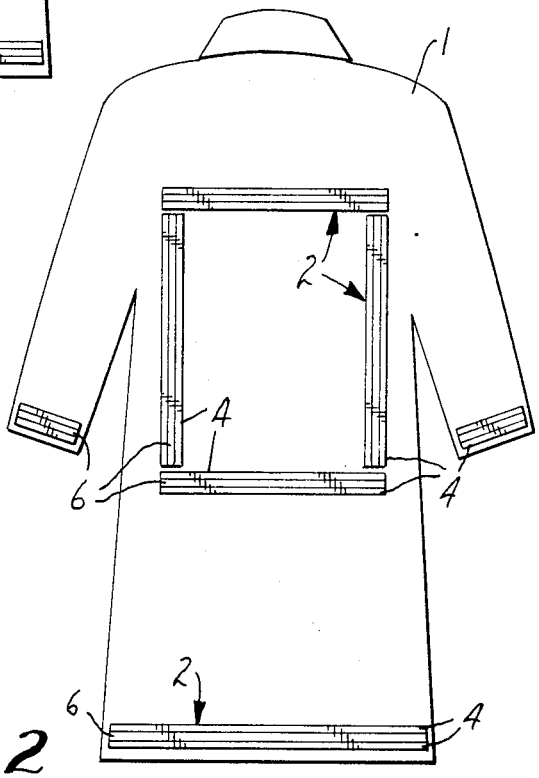

Following the transfer of the fluorescent coating to the flame retardant treated fabric, the fabric was slit into pieces two inches (51 mm) wide, and a $\frac{5}{8}$ (16 mm) inch wide ribbon of retroreflective sheeting was laminated to the center of such pieces in accordance with the laminating process just described (FIGS. 1 and 2.)

The retroreflective sheeting was made as follows: glass microspheres ranging from 40 to 60 micrometers in diameter and having a refractive index of 1.92 were partially embedded into a polyethylene-coated paper to a depth of approximately $\frac{1}{3}$ their diameter by passing the web through an oven at about 295° F. (146° C.). The exposed portion of the beads were then coated with aluminum by a vacuum vapor coating process. A layer of binder material was knife coated over the aluminum coating to provide a 0.008 inch (0.2 mm) thick wet coating. The binder material comprised a mixture of 17.4 parts acylonitrile-butadiene elastomer (Hycar 1001×255 from B. F. Goodrich Chemical Company) 23.2 parts of a solution comprising phenol formaldahyde one step type thermosetting resin dissolved at 50% solids in methylisobutylketone (DUREZ 1429 obtained from Hooker Chemical Company) and 3.5 parts dioctyl phthalate plasticizer, the whole mixture being dissolved in methylisobutylketone at a solids concentration of 32.5%. The binder coat was dried in an oven.

Next, an adhesive material was prepared from a high molecular weight thermoplastic polyurethane made from an aromatic diisocyanate and a polyester (obtained as Estane 5713 from B. F. Goodrich Chemical Company) dissolved in a mixture of methylethylketone and dimethylformamide at a level of 22% solids. This adhesive was knife coated onto the binder layer to provide a 0.2 mm thick wet layer and the layer was oven dried. Immediately following the oven drying, a 2 mil (51 micrometers) thick polyethylene layer was pressurelaminated to the adhesive side to provide a protective coating during handling. The result was a sandwich construction with the exposed lens retroreflective sheeting in the middle, the polyethylene layer protecting the adhesive side, and the coated paper protecting the glass beads.

The polyethylene layer was stripped from the adhesive prior to laminating the retroreflective sheeting to the 2 inch (51 mm) wide trim strips, and the polyethylene coated paper was removed after the final lamination step described above to expose the retroreflective sheeting (FIGS. 1 and 2.)

Example II

Samples of the trim material of this invention made by the process described above in Example I were tested for flame resistance and retention of reflectivity. Control samples subjected to the same tests were a commercially available trim material for firemen's coats Reflexite Trim (by Reflexite Corp. of New Britain, Conn.). Unless otherwise noted the test methods are from U.S. Federal Test Method Standard 191, "Textile Test Methods". The test results are presented below.

| Test | Control | Trim of this Invention |
|---|---|---|
| Char Length Method 5903 | 1.2 in. (30 mm) | 1.25 in. (32 mm) |
| After Flame-Method 5903 | 0.4 sec. | 0.2 sec |
| Reflectivity (R)* | 242 | 320 |
| Reflectivity (R)* after 5 min. @ 149° C. | 48 | 320 |
| Reflectivity (R)* after 5 min. @ 177° C. | 0 | 320 |
| Reflectivity (R)* after 5 min. @ 204° C. | 0 | 313 |
| Reflectivity (R)* after 5 min. @ 232° C. | 0 | 310 |
| Reflectivity (R)* after 5 min. @ 260° C. | 0 | 243 |

*R is coefficient of luminous intensity reported in candelas/lux for samples of 325 $in^2$ (2097 $cm^2$) as defined in ASTM Designation E 808-81 and determined by the procedure in ASTM Standard E 809-81.

When placed in a forced air laboratory oven at 260° C. for five minutes, the control charred, melted, and separated from the fire retardant cotton duck to which it had been sewn. The trim material of this invention, on the other hand, retained its retroreflectivity and did not char, melt or separate. It would remain on fire fighters' protective garments much longer giving greater night time visibility and would not melt under severe conditions to possibly drip and cause harm to fire fighters.

Other embodiments of this invention will be apparent to those skilled in the art from a consideration of this specification or practice of the invention disclosed herein. Various omissions, modifications and changes to the principles described herein may be made by one skilled in the art without departing from the true scope and spirit of the invention which is indicated by the following claims:

What is claimed is:

1. A material suitable for incorporation into fabrics which will be exposed to high temperatures comprising a fire resistant fabric having a weight of at least 85 grams per square meter and characterized by:

(A) a fluorescent coating on the fabric;

(B) a flexible, drapable, stretchable, retroreflective sheeting covering a portion of the material and comprising a layer of transparent lens elements in optical connection with a reflecting means;

(C) the combined thicknesses of the fluorescent coating and any flammable part of the retroreflective sheeting being about 5 to 60 percent of the thickness of the fire resistant fabric.

2. The trim material of claim 1 wherein the fire resistant fabric is selected from the group consisting of cotton treated with a fire resistant chemical, modacrylic fabrics, glass fiber fabric, ceramic fiber fabric, aramid fabrics and blends of the foregoing.

3. The trim material of claim 1 wherein the fire resistant fabric is about 0.1 to 2.5 millimeters thick.

4. The trim material of claim 1 wherein the reflecting means of the retroreflective sheeting is selected from the group consisting of a reflective metal coating on the lens elements, reflective metal particles dispersed in a matrix and located behind the lens elements and a dielectric reflector located behind the lens elements.

5. The trim material of claim 4 wherein the transparent lens elements of the retroreflective sheeting are selected from the group consisting of cube corner lens elements and glass beads having a diameter between about 40 and 150 micrometers and an index of refraction of at least about 1.7.

6. The trim material of claim 5 wherein the retroreflective sheeting is an exposed lens retroreflective sheeting utilizing glass beads as the lens element.

7. The trim material of claim 5 wherein the retroreflective sheeting is enclosed lens sheeting utilizing glass beads as the lens elements and having a transparent spacing layer between the lens elements and the reflecting means.

* * * * *